US007368883B2

(12) United States Patent
Chan et al.

(10) Patent No.: US 7,368,883 B2
(45) Date of Patent: May 6, 2008

(54) APPARATUS FOR END-OF-LIFE DETECTION OF FLUORESCENT LAMPS

(75) Inventors: Yick Po Chan, Hong Kong (CN); Franki Ngai Kit Poon, Hong Kong (CN)

(73) Assignee: Power ELab Ltd., Hong Kong (HK)

( * ) Notice: Subject to any disclaimer, the term of this patent is extended or adjusted under 35 U.S.C. 154(b) by 211 days.

(21) Appl. No.: 11/402,126

(22) Filed: Apr. 12, 2006

(65) Prior Publication Data

US 2007/0241693 A1 Oct. 18, 2007

(51) Int. Cl.
*H05B 37/02* (2006.01)

(52) U.S. Cl. ..... 315/307; 315/276; 315/291

(58) Field of Classification Search ..... 315/209 R, 315/219, 224, 276, 291, 307; 363/34, 37
See application file for complete search history.

(56) References Cited

U.S. PATENT DOCUMENTS

| | | | | |
|---|---|---|---|---|
| 5,237,243 | A * | 8/1993 | Chung | 315/219 |
| 5,398,181 | A * | 3/1995 | Yeh | 363/95 |
| 6,057,652 | A * | 5/2000 | Chen et al. | 315/307 |
| 2003/0107332 | A1 * | 6/2003 | Newman et al. | 315/307 |

* cited by examiner

*Primary Examiner*—Thuy V. Tran
*Assistant Examiner*—Jimmy T Vu

(57) ABSTRACT

In fluorescent lamp lighting, it is required that when the lamp reaches its end of life there has to be some mechanism to shut down the power supply to the lamp for safety. In the present invention, an apparatus is proposed to fulfill this requirement. This invention comprises of a lamp, means to sense currents at the lamp filaments and the imbalance of the currents is detected and turn off the power source to the lamp. Several embodiments are included to illustrate the execution of this invention.

8 Claims, 7 Drawing Sheets

Band-pass Signal conditioning circuit

APPARATUS FOR END-OF-LIFE DETECTION OF FLUORESCENT LAMPS

BACKGROUND OF THE INVENTION

In fluorescent lighting, there is a requirement for end-of-life detection which is listed in ANSI C82.11 (Consolidated-2002). The requirement states that for lamps with tube diameter which is equivalent to T5 size or smaller must have a protection method when the lamp's end-of-life symptoms occurred to avoid hazardous conditions.

FIG. 1 shows a prior art ballast configuration with an inductor-capacitor (LC) resonator. A lamp 101 is connected in parallel with the resonance capacitor 102 with an alternating power source 103 and the resonating inductor 104 connected in series. To start the lamp the resonator is activated and a high voltage is established across the capacitor which in turn strikes on the lamp. After the lamp is stroke on the lamp voltage falls to a lower value while it operates in the steady state.

It is required that the ballast shall not impair safety when abnormal and fault conditions happen. Abnormal conditions are classified (European standard) as:

a) lamp not inserted;
b) the lamp does not start because one of the two cathodes are broken;
c) the lamp does not start although the cathodes are intact;
d) the lamp operates, but a single cathode is de-activated or broken (rectifying effect).

It is desired that the ballast shall have appropriate protections against the four scenarios listed above. In scenarios a), b) and c), if the lamp is unable to be stroked on during the startup phase, the ballast may develop a dangerously high voltage arc across the two ends of the lamp holder, which causes an electrical shock hazard to the technician who may try to replace the lamp, therefore protection must then be enabled. Typically, there are two common detection methods:

1) Current Sensing detection
2) Voltage Sensing Detection

A common current sensing detection method utilizes the inverter choke current as a sensing parameter. By placing a sensing resistor connected between the source of the low side driver and the ground, the choke current is monitored throughout the startup phase. If the lamp is not present or it cannot be ignited, high current will continue to flow through the sensing resistor since the LC resonator will operate at its resonant frequency after the preheat phase with infinite lamp resistance.

Voltage sensing detection is similar to current sensing detection in which the lamp voltage is utilized as the sensing parameter. Over-voltage condition will occur if the lamp does not strike on as the ballast runs in its resonant mode.

In scenario d), the lamp may suffer an imbalance of current flow in alternating direction which is commonly known as the rectifying effect, where one end of filament act as the cathode and the other end act as an anode. In particular, a broken or disconnected filament in a running lamp is a typical end-of-life failure where current sensing detection and voltage sensing detection may be unable to protect the lamp as the lamp is still in an operation mode. This may result in overheating the filament at one end which may melt the glass tube. Consequently this may cause an electrical shock hazard and overheating hazard to the user.

In all cases, end-of life detection usually involves a combination of detection of high voltage across the lamp and the choke current. If the lamp is unable to be stroked on, then voltage and current sensing techniques are already enough to confirm the lamp is at its end-of-life status. Yet, if the lamp is able to be stroked on, only the lamp voltage, filaments status or the rectification of the lamp current may show the End-of-life. However, detection of lamp voltage is unreliable in a sense that the lamp voltage is highly changeable with different operating ambient temperature. Moreover, electronic ballast with dimming function nowadays is very common and voltage detection technique may not be adequate as the lamp voltage could change drastically at different dimming levels with a difference of typically 30-40%. The consequence would be the lamp safety is seriously impaired unless every condition is checked.

In U.S. Pat. No. 6,819,063, Arthur Nemirow has provided a method to sense the filament status in a fluorescent lamp. His invention includes a DC flyback converter to drive the filaments and a separate alternating power source to drive the lamp with multiple outputs act as voltage sources across each of the filament. Due to the open circuit flyback effect and cross-regulation feature of the converter, output voltage will experience a sharp increase in voltage if the load tends to an open load, i.e. the filament is broken. A threshold voltage is then sensed and triggers a protection mechanism to inhibit the output of alternating power to the lamp. There is an advantage in sensing the filament resistance with an isolated circuitry because the lamp usually has high AC voltage across it, i.e. at least one end of the filaments will be at high voltage. Sensing parts at high voltage would not be ideal since the control logic is at low-voltages. However, such method has a few drawbacks where an isolated component, such as opto-coupler is required and it is commonly known that its current transform ratio (CTR) deteriorates against time, produces a change in the sensed voltage level unintentionally. High component counts with an integrated switch at primary side of the DC flyback converter contribute extra cost. Moreover, it provides no information on the potential differences of the two filaments where the amount of difference could indicate one type of rectifying effect.

Thus, there is a need for improving End-of-life detection mechanism, particularly in sensing the difference between filaments in a fluorescent lamp and also the rectifying effect, which must be immune from factors such as operating temperature and lamp condition. The new method should be relatively economical, while providing a more complete and reliable protections to End-of-life. The present invention addresses these needs as described herein.

SUMMARY OF THE INVENTION

It is therefore an object of the present invention to provide end-of-life protection to fluorescent lamps. When the lamp has reached its end-of-life, the present invention makes an appropriate detection and sends off a signal to shut down the power source for the lamp.

Briefly, the present invention comprises an alternating power source, a fluorescent lamp, power supply arrangements to provide power to heat up the two filaments in the fluorescent lamp. Furthermore, the present invention comprises a transformer with multiple windings. Two of the transformer windings are connected in such a way to detect filament currents in the two different filaments. The windings are constructed in such a way that the signals of these two windings cancel each other in normal operation. The transformer has a further third winding which is coupled to a signal conditioning circuit which in turn produces an output fault signal which shuts down the power source when the lamp has reached its end-of-life.

In operation, the alternating power source provides power to the fluorescent lamp. Separate power supply arrangements provide power to the two filaments. Two windings of the transformer detect the filament currents. When the lamp is in a healthy state, the two detected filament currents should cancel out each other and produce no signal at the transformer third winding. However, when the lamp has reached its end-of-life, the filament currents become asymmetrical and are no longer able to cancel out each other. The residue signal is picked up by the third winding of the transformer. This signal goes through a signal conditioning circuit where it is compared with a preset reference. If the residue signal is higher than the preset reference a fault signal is produced which in turn turns off the alternating power source.

In an alternative embodiment, power supply for the two filaments in the lamp come from the main alternating power source. A capacitor is arranged in such a way to carry the filament current in parallel with the lamp. Similar to the first embodiment, this second embodiment has a transformer with three windings. Two windings detect the filament currents. When the lamp has reached its end-of-life the currents become asymmetrical and a signal is produced at the third winding of the transformer. This signal then goes through a signal conditioning circuits and turns of the alternating power source.

In a further alternative embodiment, two transformers are used instead of one while the arrangement of an alternating power source and a lamp is basically the same as the first embodiment. The two transformers are arranged to detect current from the alternating power source. One of the transformers has rectifier on its secondary winding arranged to pick up the positive portion of the filament current, while another one of the transformers has rectifier on its secondary winding arranged to pick up the negative portion of the filament current. The positive portion and a negative portion of the current signals are added together which should produce a zero signal when the lamp is healthy while the current waveform is symmetrical. When the lamp has reached its end-of-life the waveform becomes asymmetrical and a non-zero signal is produced. It is picked up by a low pass filter and furthermore passed through a signal conditioning circuit where the signal is compared with an internal reference. A fault signal will be produced if the current imbalance exceeds the internal reference. This fault signal is coupled to the alternating power source and turns it off.

BRIEF DESCRIPTIONS OF THE DRAWINGS

DETAILED DESCRIPTION OF THE PREFERRED EMBODIMENTS

Figure 1:
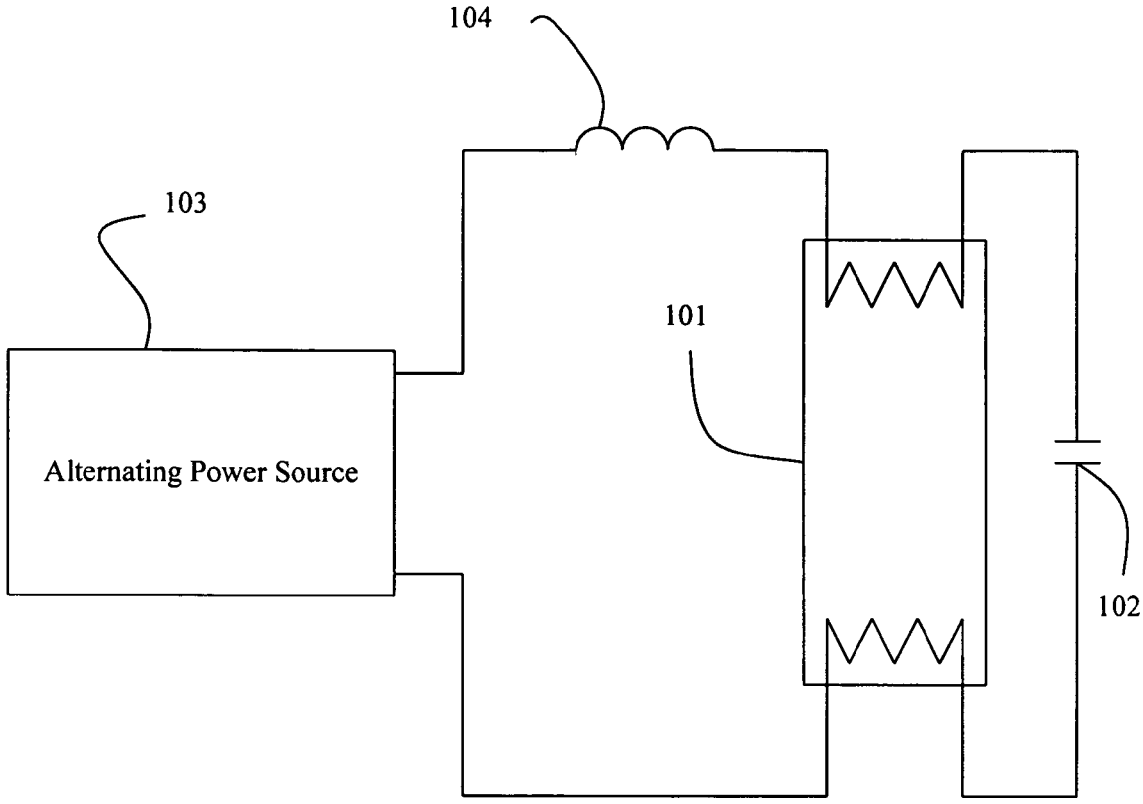
FIG. 1 (Prior Art)
FIG. 1 is a prior art configuration of a fluorescent lamp with filaments driven by an alternating power source.
Figure 2:
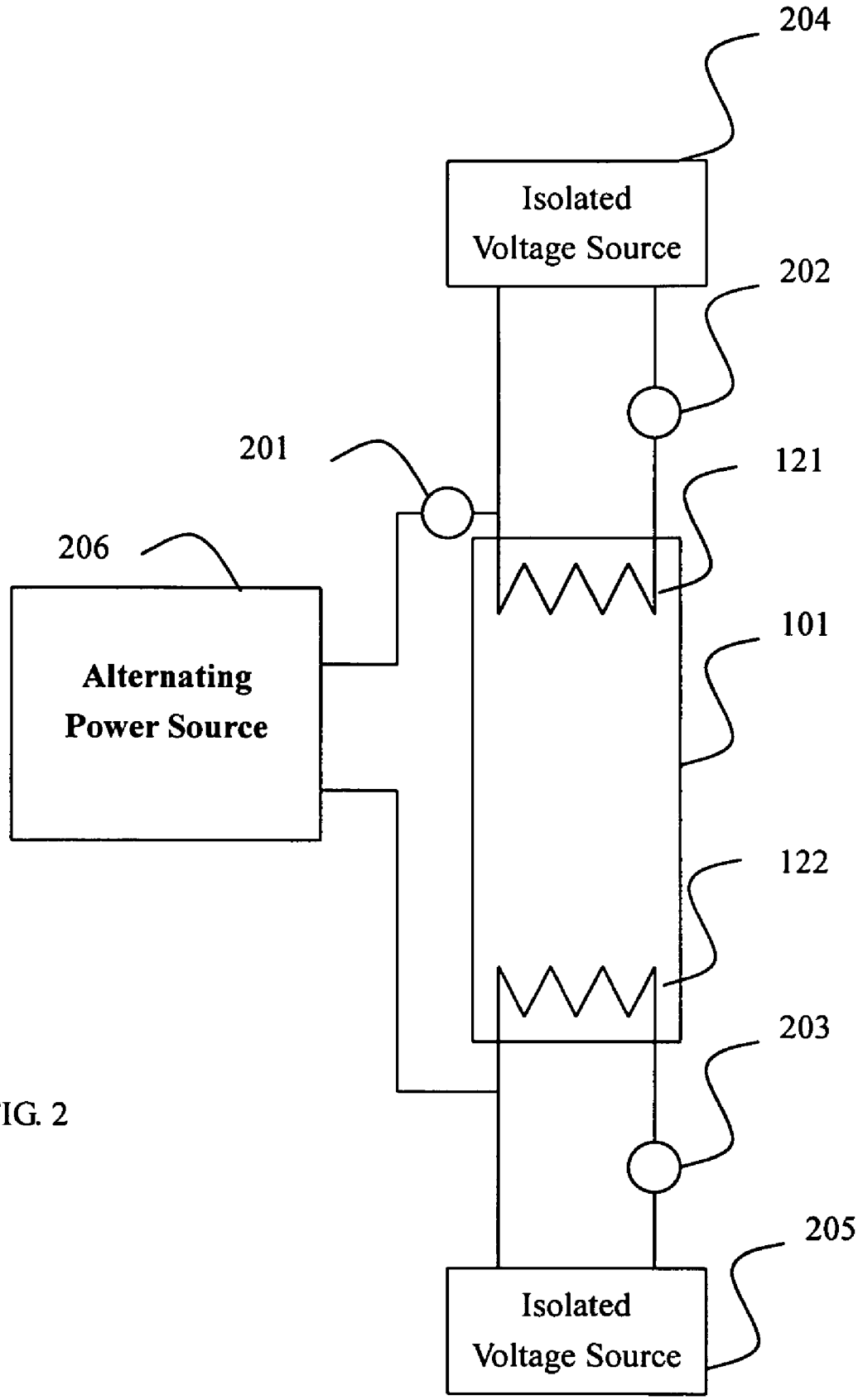
FIG. 2 is a schematic diagram which explains the principle of the present invention.

The principle of the present invention is explained by apparatus shown in FIG. 2. It comprises of a main alternating power source 206 coupled to a fluorescent lamp 101. The lamp has two filaments 121 and 122 at its ends. Two isolated voltage sources 204 and 205 are coupled respectively the said filaments which provide power to heat up these filaments. This method is known as voltage-mode driven filament. This apparatus also comprises of detector 201 which is a means to detect current supply to the lamp by said alternating power source 206. This apparatus further comprises detectors 202 and 203 which are means to detect filament current supplies from said isolated voltage sources. When the lamp comes to its end-of-life Rectifying Effect could be detected by sensing the lamp current detected by 201, 202 and 203.

Figure 3:
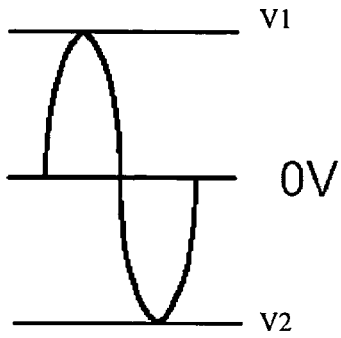
FIG. 3 is a current waveform drawn by a healthy lamp.
Figure 4:
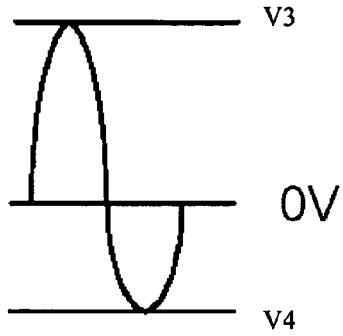
FIG. 4 is a current waveform drawn by a lamp near its end-of-life.

FIG. 3 and FIG. 4 illustrate the lamp current waveforms of a healthy lamp and a lamp reaching its end-of-life with rectifying effect respectively. These current signals can be sensed by detector 201, which can be used to detect current imbalance in the alternating power cycle. A healthy lamp should have symmetrical current waveform in an alternating power cycle. In FIG. 3 the voltage magnitude V1 should be equal to V2 while the signal average level (DC level) is be detected as zero. When a lamp reaches its end-of-life a rectifying effect shows up as illustrated by FIG. 4, where voltage magnitude V3 will not be equal to V4 and the DC level will be either positive or negative with a non-zero value. The principle of the present invention is to detect such non-zero DC level. If this level exceeds a certain threshold the main alternating power source will be shut down for safe lamp operation.

Now, if the lamp rectifying effect is caused by a deteriorated or broken filament, filament current detectors 202 or 203 will indicate changes in filament current. Threshold detection technique can be easily applied for safe and accurate lamp protection.

Figure 5:
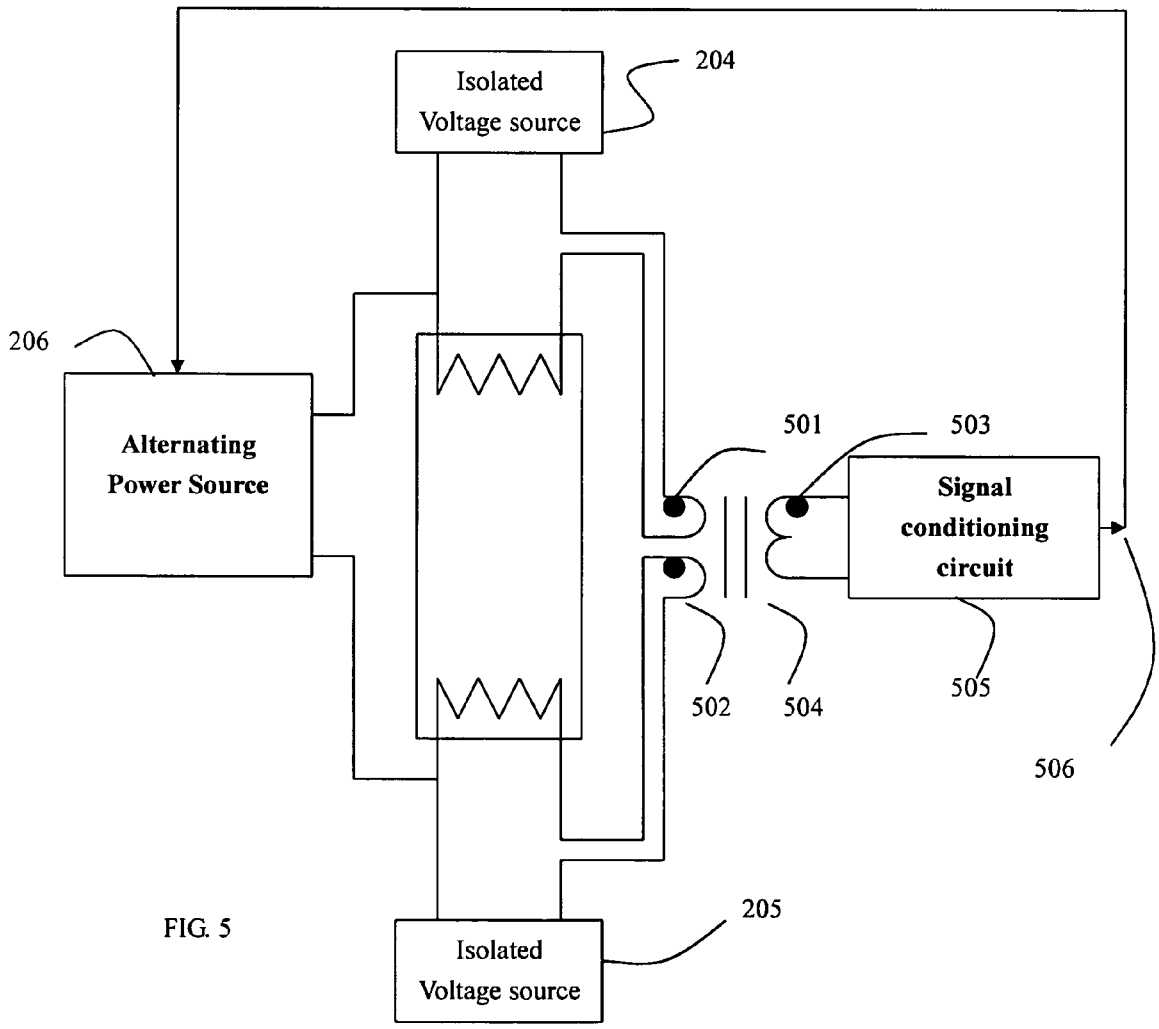
FIG. 5 is a first embodiment of the present invention.

In FIG. 5, a first embodiment of the present invention for a fluorescent light system is shown. It comprises a primary alternating power source 206 which provides power to a fluorescent lamp through its two terminals. The fluorescent lamp has two filaments at its ends and they are powered up by two isolated voltage sources 204 & 205. These two voltage sources produce voltages with the same magnitude but opposite phases. In general these two voltage sources for filament currents are coupled from the primary alternating power source 206 to ensure that they are synchronized. The embodiment further comprises of a transformer 504 which has at least three windings, namely 501, 502 and 503. The filament current signals are picked up by windings 501 and 502 of transformer 504. Winding 503 produces a signal in fault conditions which is coupled to a signal conditioning circuit 505, which has an output signal 506 coupled to the primary alternating power source.

Here operation of the first embodiment is described. In normal operation when the lamp is at a healthy state, filaments at the two ends of the fluorescent lamp have the same characteristics so filament currents through windings 501 and 502 are equal in magnitude but in anti-phase. Windings 501 and 502 therefore generate equal but opposite flux and cancel each other where the third winding 503 sees the overall flux level around the core which is equal to zero. When there is a change in one of the filament resistance, say due to deterioration of the filament, the flux cancellation mechanism is upset causing an AC voltage induced in winding 503. A signal conditioning circuit picks up this AC voltage signal and decides if the lamp has reached the end of life. If so it sends off a signal and shut down the primary alternating power source to the lamp. This serves the objective of inhibiting the power source to a fluorescent lamp when it has reached its end of life.

Figure 6:
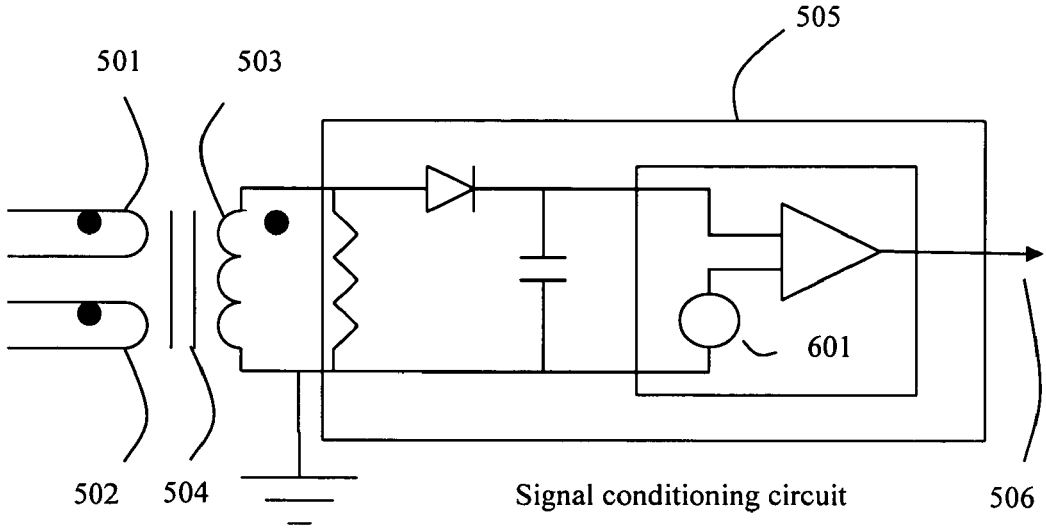
FIG. 6 is an embodiment of a signal conditioning circuit.

An embodiment of the signal conditioning circuit 505 is shown in FIG. 6. The signal conditioning circuit captures current generated in winding 503 of transformer 504, when this current level exceeds a reference value this indicates a filament has deteriorated and a signal 506 is issued to shut down the primary power source to the lamp. Here a typical configuration is show. A resistor turns current signal in winding 503 into voltage signal. A circuit with a diode and a capacitor pick up the amplitude of the AC voltage sensed at 503. This voltage is compared with an internal reference voltage 601 by a comparator and a signal 506 will be issued to disable the primary alternating power source if this voltage exceeds the reference voltage. An internal reference voltage 601 can either be preset or made adjustable to respond to different operating conditions. There are many other possible embodiments but the operating principle should prevail under the scope of this invention.

It is obvious to those having ordinary skill in the art that there are many ways to detect an amplitude voltage. The embodiment so described is illustrative rather than restrictive while the principle of operation prevails.

Figure 7:
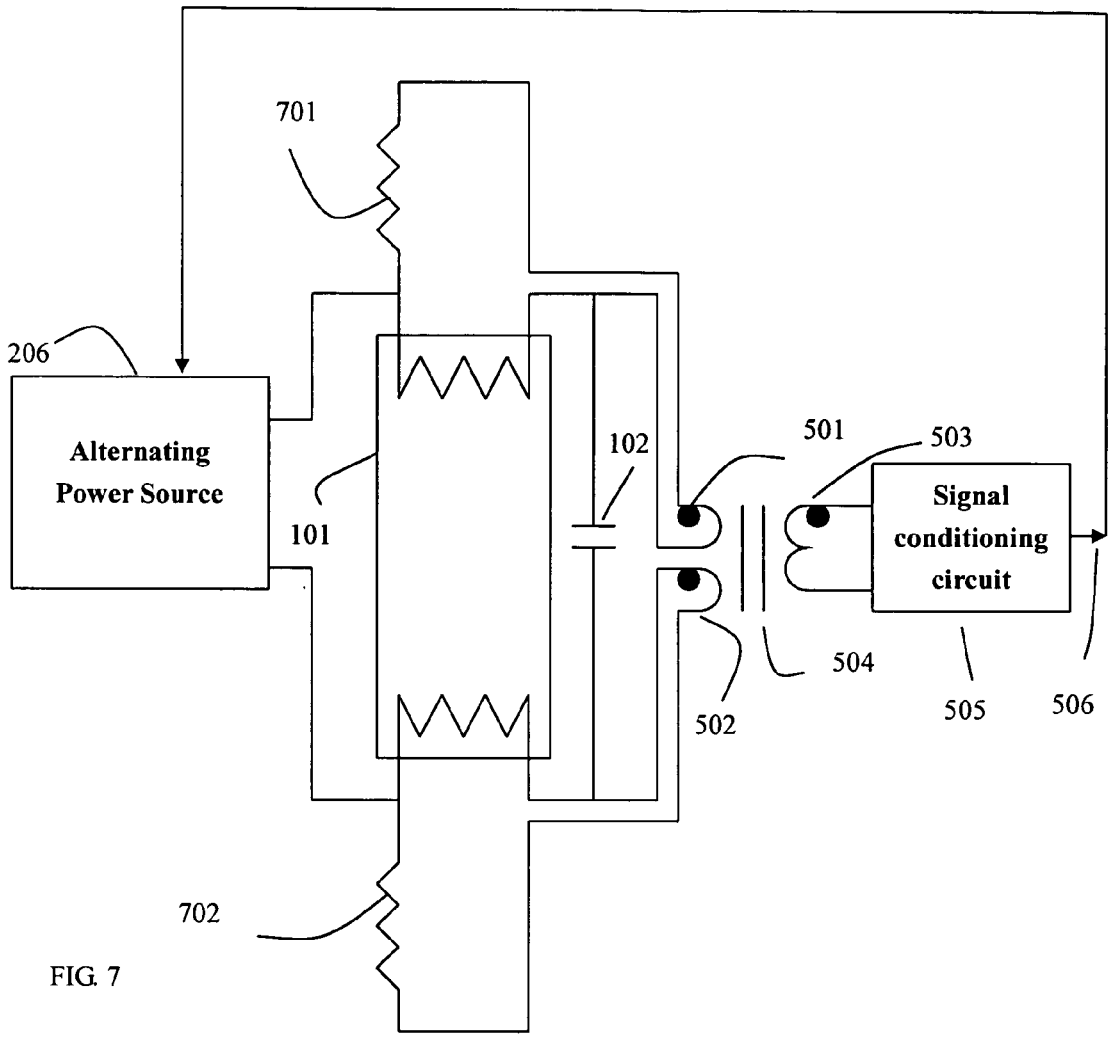
FIG. 7 is a second embodiment of the present invention.

A second embodiment of the present invention is shown in FIG. 7. It comprises of an Alternating Power Source 206 having two terminals coupled to the filaments of a fluorescent lamp 101. Like all typical fluorescent lamps this lamp 101 has two filaments at its ends each having a filament terminal pair. Each filament terminal pair has one of its terminals coupled to Alternating Power Source 206 and the other coupled to a capacitor 102. This embodiment further comprises a transformer 504 at least three windings 501, 502 & 503. A resistor 701 coupled in series with a winding 501 of transformer 504 are coupled in parallel to a filament terminal pair. The other filament terminal pair has a similar arrangement which connects in parallel to a resistor 702 in series with a winding 502 of transformer 504. In addition to windings 501 and 502 transformer 504 has a third winding 503 which is coupled to a signal conditioning circuit 505. This signal conditioning circuit 505 has an output signal 506 which is coupled back to Alternating Power Source 206 for control purpose.

Operation of the second embodiment is described herein. During normal operation, Alternating Power Source 206 drives current to the lamp filaments. At the lamp filaments some current flows through the lamp as lamp current while some flow through capacitor 102 as filament current. Only a small amount of current flows through the two parallel circuits having resistor 701 and winding 501, or resistor 702 and winding 502 at the other end of the lamp because resistors 701 and 702 are designed to have a higher value than the filament resistance. Symmetrical arrangement of the configuration produces the same current in these two circuits in normal operation when the lamp is healthy. Windings 501 and 502 of transformer 504 are constructed in such a way that current flow in these two windings cancels out the magnetic flux produced by each other. A third winding 503 of transformer picks up the difference in magnetic flux produced by windings 501 and 502. In normal healthy lamp operation no flux is picked up by winding 503 as flux produced by windings 501 and 502 cancel out each other. When the lamp deteriorates one of the lamp filaments may break or produces a significant change in resistance. This forces current into its parallel circuit and produces different currents in windings 501 and 502. Winding 503 then picks up the imbalance signal and presents to a signal conditioning circuit which in turn produces a signal 506 to inhibit the Alternating Power Source 206. This serves the objective of inhibiting the power source to a fluorescent lamp when it has reached its end of life.

Figure 8:
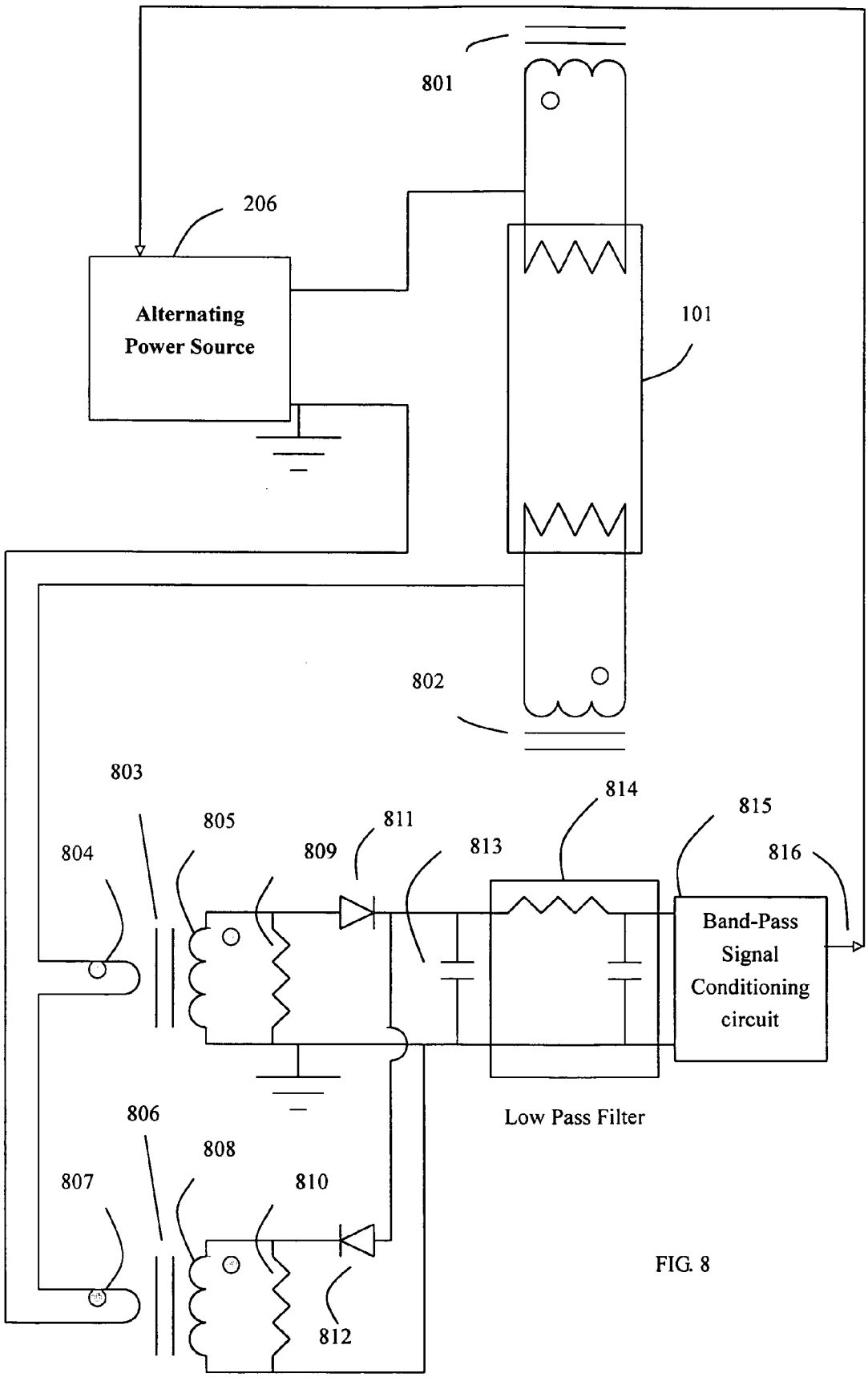
FIG. 8 is a third embodiment of the present invention.

A third embodiment of this invention is shown in FIG. 8. It comprises a primary alternating power source 206 which provides power to a fluorescent lamp 101 through its two terminals. The fluorescent lamp has two filaments at its ends and they are powered up by two isolated voltage sources 801 and 802. The lamp current delivered by the alternating power source 206 is monitored by two current transformers 803 and 806. The lamp current passes through the respective windings 804 and 807 of these transformers which are connected in series. The current transformers 803 and 806 have secondary windings 805 and 808 respectively. These secondary windings produce the same alternating signal as the transformers monitor the same current. However rectifiers 811 and 812 are connected to secondary windings 805 and 808 in such a way that rectifier 811 picks up the positive portion of the alternating signal produced by secondary winding 805 and rectifier 812 picks up the negative portion of the alternating signal produced by secondary winding 808. The cathode of rectifier 811 is coupled to the anode of rectifier 812 and further couples to a capacitor 813. Capacitor 813 is coupled to a low pass filter 814 followed by a Band-Pass Signal Conditioning circuit 815. This Band-Pass Signal Conditioning circuit has an output signal when the absolute value of the detected signal is greater than an internal preset threshold 901.

Figure 9:
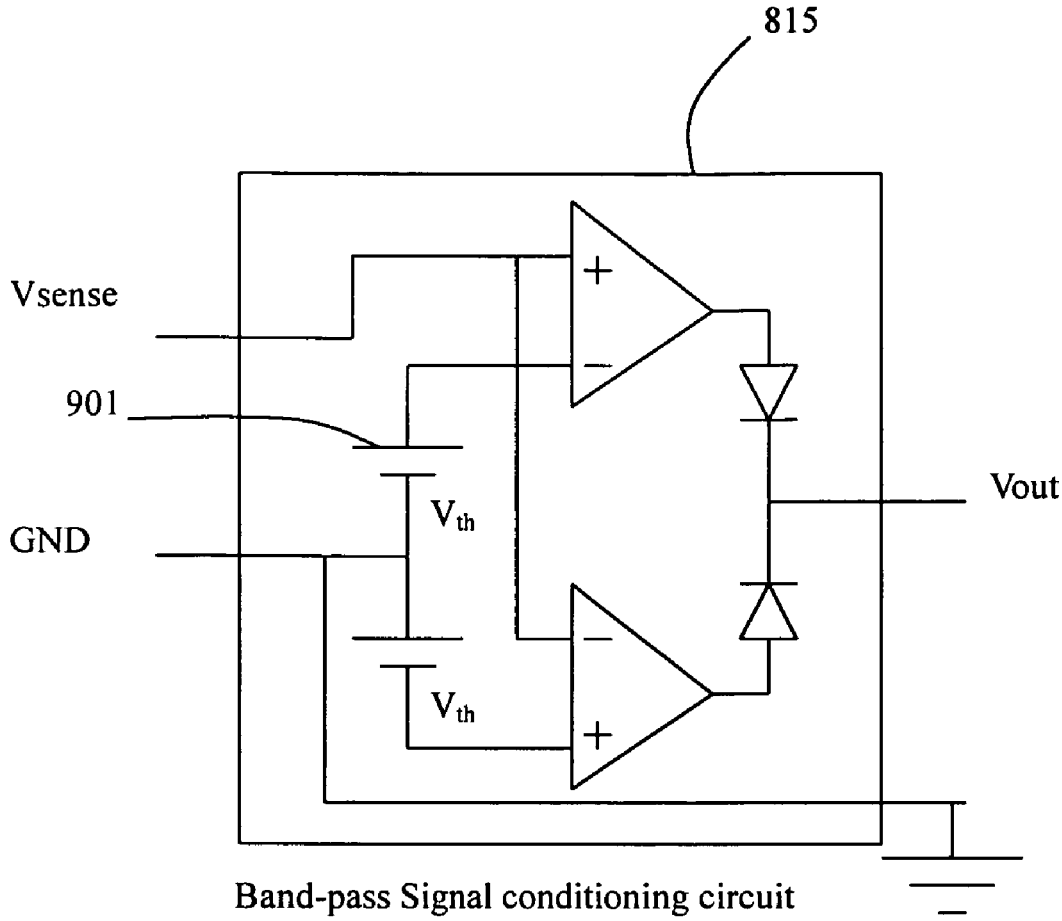
FIG. 9 is a band pass signal conditioning circuit.

Operation of the third embodiment is described herein. During normal operation, Alternating Power Source 206 drives current through the lamp. When the lamp is healthy the alternating lamp current should be symmetrical and its waveform has equal positive portion and negative portion. The lamp current is monitored simultaneously by two current transformers 803 and 806 respectively. They produce the same output signal. However this signal is rectified by different rectifiers 811 and 812 such that rectifier 811 captures the positive portion and rectifier 812 captures the negative portion of the signal. If the lamp is healthy the lamp current is symmetrical the combined signal will have a zero level and no fault signal is produced. If the lamp has reached its end-of-life rectifying effect will come out. A signal with a magnitude will appear at the node where rectifiers 811 & 812 are connected. This signal is then passed through a low pass filter 814 which is further coupled to a band-pass signal conditioning circuit 815. FIG. 9 illustrates such a band-pass signal conditioning circuit. It comprises of two comparators each having its own voltage reference 901 trigger levels. When the incoming signal exceeds the internal reference threshold level whether this signal is positive or negative, one of the comparators will be triggered and produces a fault signal at the output. The fault signal 816 in FIG. 8 is then coupled to said Alternating Power Source 206 and turns it off.

The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims.

What is claimed is:

1. An apparatus for fluorescent lamp comprising:

a power source producing an alternating voltage with two terminals;

a fluorescent lamp with filaments fitted to its first and second terminal pairs and these lamp terminal pairs are coupled to said terminals of said power source;

a first voltage source coupled to said lamp first terminal pair and drives a current through said filament fitted to this first terminal pair;

a second voltage source coupled to said lamp second terminal pair which drives a current through said filament fitted to this second terminal pair;

a transformer having at least three windings magnetically coupled together, a first winding coupled in series with said first voltage source which detects current flow through this first voltage source, a second winding coupled in series with said second voltage source which detects current through this second voltage source, a third winding with two terminals, whereby these three windings are magnetically coupled and constructed in a way such that said third winding produces a current related to difference between the current in said second winding and the current in said first winding;

a signal conditioning circuit coupled to terminals of said third winding of said transformer which accepts current in this third winding and produces a command signal which inhibits said power source when current in this third winding exceeds a preset level.

2. The apparatus for fluorescent lamp of claim 1, wherein the signal conditioning circuit of claim 1 further comprising:

means to convert an input current to a first voltage;

a comparator which compares said first voltage with a reference voltage;

means to produce an output signal to inhibit power delivery to fluorescent lamp when said first voltage exceeds the magnitude of said reference voltage.

3. The apparatus for fluorescent lamp of claim 2, wherein the signal conditioning circuit further comprising means to adjust said reference voltage.

4. An apparatus for fluorescent lamp comprising:

a power source producing an alternating voltage with two terminals;

a fluorescent lamp with filaments fitted to its first and second terminal pairs and these terminal pairs are coupled to said two terminals of said power source;

a first capacitor coupled in series with said two lamp terminal pairs in a way that lamp filament current flows through this first capacitor;

a transformer having at least three windings magnetically coupled together, namely a first winding, a second winding and a third winding whereas these three windings are constructed in a way such that said third winding produces a current related to the difference between the current in said first winding and the current in said second winding;

a first resistor coupled in series with said first winding of said transformer while these two series components are coupled in parallel to said first terminal pair of said fluorescent lamp;

a second resistor coupled in series with said second winding of said transformer while these two series components are coupled in parallel to said second terminal pairs of said fluorescent lamp;

a signal conditioning circuit coupled to terminals of said third winding of said transformer which accepts current in this third winding and produces a command signal which inhibits said power source when current in this third winding exceeds a preset level.

5. The apparatus for fluorescent lamp of claim 4, wherein the signal conditioning circuit comprising:

means to convert an input current to a first voltage;

a comparator which compares said first voltage with a reference voltage;

means to produce an output signal to inhibit power delivery to fluorescent lamp when said first voltage exceeds the magnitude of said reference voltage.

6. The apparatus for fluorescent lamp of claim 5, wherein the signal conditioning circuit further comprising means to adjust said reference voltage.

7. An apparatus for fluorescent lamp comprising:

a power source producing an alternating voltage with two terminals;

a fluorescent lamp with filaments fitted to its first and second terminal pairs and these lamp terminal pairs are coupled to said terminals of said power source and produce a first circuit;

a first voltage source coupled to said lamp first terminal pair and drives a current through said filament fitted to this first terminal pair;

a second voltage source coupled to said lamp second terminal pair which drives a current through said filament fitted to this second terminal pair;

a first transformer having at least two windings magnetically coupled together, a first winding coupled in series with said first circuit through which current from said power source flows, a second winding coupled to a first resistor which produces a voltage corresponding to current in this second winding, while this second winding further couples to anode terminal of a first diode;

a second transformer having at least two windings magnetically coupled together, a first winding coupled in series with said first circuit through which current from said power source flows, a second winding coupled to a second resistor which produces a voltage corresponding to current in this second winding, while this second winding further couples to cathode terminal of a second diode;

means to couple cathode terminal of said first diode and anode terminal of said second diode together such that signal produced by said first resistor is added to signal produced by said second resistor at a pair of nodes;

a low pass filter circuit having a pair of input terminals and a pair of output terminals is coupled to said pair of nodes at its input terminals;

a signal conditioning circuit having a pair of input terminals and an output signal couples its input terminals to output terminals of said low pass filter circuit, said output signal of said signal conditioning circuit is further coupled to said power source and turns said power source off when signals received by said signal condition circuit exceeds a certain preset magnitude.

8. The apparatus for fluorescent lamp of claim 7, wherein the signal conditioning circuit further comprising:

At least an internal reference for comparison with input signal fed to this signal conditioning circuit;

At least a comparator which compares said input signal with said internal reference;

Means to produce an output signal to inhibit power delivery to fluorescent lamp when said input signal exceeds the magnitude of said internal reference, regardless of whether said input signal is positive or negative.

* * * * *